United States Patent [19]

Boulachanis

[11] 4,270,804

[45] Jun. 2, 1981

[54] PUFF DUSTER AND MOP-MAKING MACHINE

[76] Inventor: Nicolas Boulachanis, 5391 Park Ave., Montreal, Canada, H2V 4G9

[21] Appl. No.: 15,093

[22] Filed: Feb. 26, 1979

[30] Foreign Application Priority Data

Feb. 28, 1978 [CA] Canada ..... 297846

[51] Int. Cl.[3] ..... A46D 9/00

[52] U.S. Cl. ..... 300/16; 140/115; 300/21

[58] Field of Search ..... 300/1, 16, 19, 21; 140/115, 149

[56] References Cited

U.S. PATENT DOCUMENTS

| | | | |
|---|---|---|---|
| 2,580,378 | 12/1951 | Peterson | 300/21 |
| 3,591,237 | 7/1971 | Swenson | 300/16 |
| 4,145,787 | 3/1979 | Bastian | 300/21 X |

FOREIGN PATENT DOCUMENTS

| | | | |
|---|---|---|---|
| 1019348 | 10/1952 | France | 300/21 |

*Primary Examiner*—Howard N. Goldberg

[57] ABSTRACT

A machine for making mops, such as dish mops and puff dusters. The machine is fed with a U-shape wire, between the legs of which extends a bundle of flexible mop strands. The machine twists the wire legs which lock the strands against the bight of the U-shape wire. The machine comprises a holding plate provided with a hole through which the legs of the U-shape wire are inserted, with the strands abutting one face of the holding plate. A power-actuated piston abuts the bight and presses the strands against the holding plate to prevent rotation of the bight relative to the plate. The machine further includes a pair of pincers located on the other side of the plate and clamping the free ends of the U-shape wire. The pincers are power-rotated for twisting the U-shape wire. Opening and closing of the pincers are effected automatically. The pincers can move towards the holding plate to allow for contraction of the U-shape wire as it is being twisted. Two guide plates are pivoted on the guiding plate to align and guide the legs of the U-shape wire for proper insertion into the pincers.

8 Claims, 8 Drawing Figures

PUFF DUSTER AND MOP-MAKING MACHINE

The present invention relates to a machine for manufacturing mops, such as dish mops, puff dusters and the like mops, wherein the flexible strands of the mop are inserted between the legs of a U-shaped wire and locked in position against the bight of the wire by twisting the legs of the latter.

Previous known machines for twisting the wire have the disadvantage of poorly clamping the strands of the mop within the bight portion of the twisted U-shape wire, because during twisting, a hook has to be inserted around the bight to prevent rotation of the bight. After removal of the hook, the strands become loosened.

Accordingly, it is an object of the present invention to provide a mop-making machine wherein there are no loose strands when the mop is finished.

It is a further object of the present invention to provide a mop-making machine which is simple and straightforward in design and construction.

These objects and others will become more apparent in the following description of a preferred embodiment of the invention, wherein the machine includes a pair of rotatable pincers to grasp the ends of a U-shape wire and to twist the same. The machine includes a holding plate disposed in front of the pincers and having a hole through which the legs of the U-shape wire are inserted with the flexible strands extending across the front face of the plate. A pusher means is adapted to press the bight of the U-shape wire and firmly apply the strands against the plate to prevent rotation of the bight and strands during twisting of the wire by the rotating pincers. Preferably, means are provided to allow relative longitudinal movement of the holding plate and pincers to compensate for longitudinal contraction of the wire during its twisting. Preferably, guide means are provided to guide the legs of the wire for proper insertion between the open pincers during introduction of the wire through the plate hole. Preferably, power means are provided to open and close the pair of pincers.

The above will be more clearly understood by referring to the drawings, in which.

In the drawings, like reference characters indicate like elements throughout.

Figures 1, 2, 3:
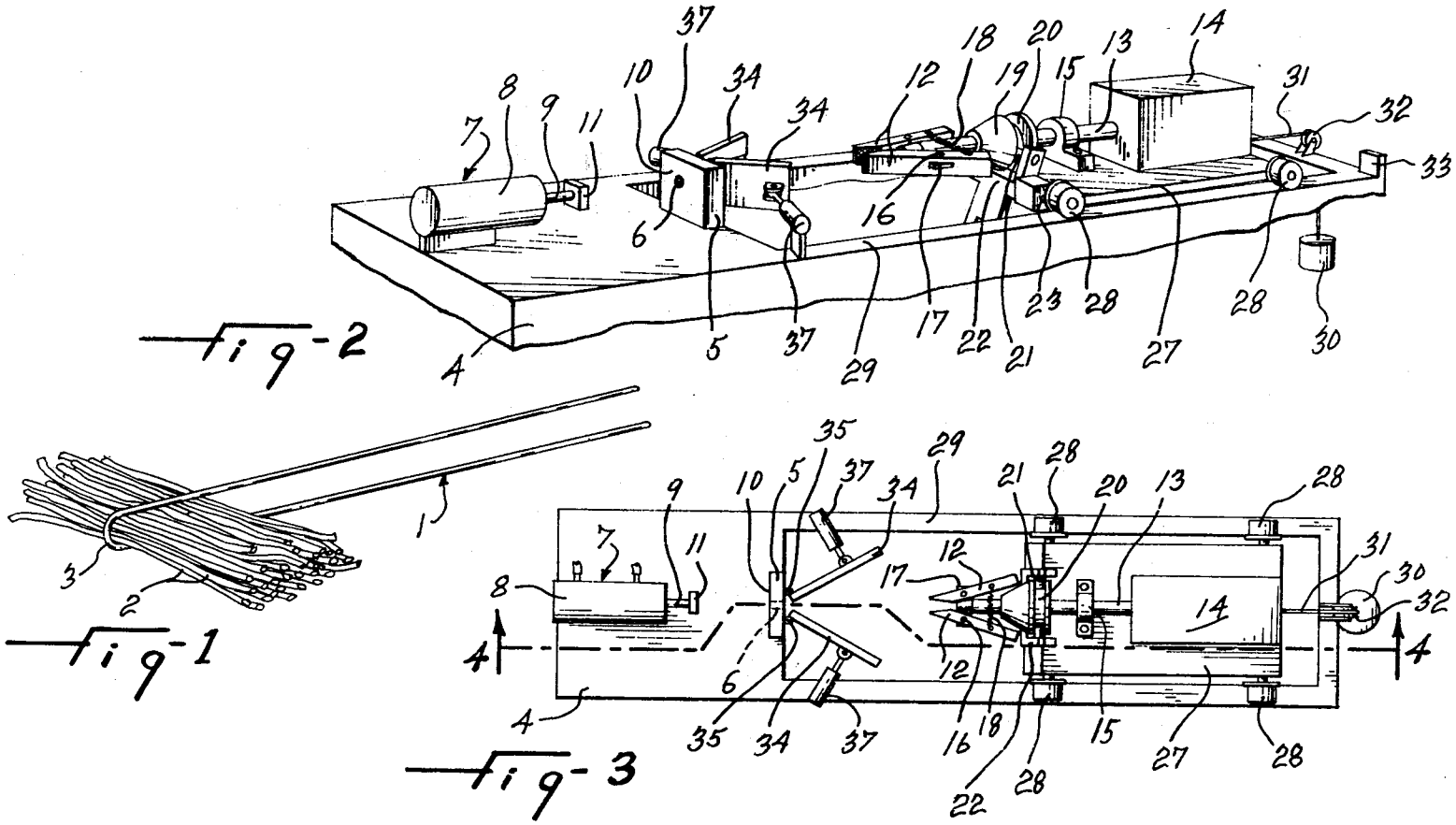
FIG. 1 is a perspective view of a U-shape wire and strands assembly as fed to the machine.
FIG. 2 is a perspective view of the machine.
FIG. 3 is a top plan view of the same.

The machine of the invention is adapted to be fed with a U-shape wire 1, as shown in FIG. 1, between the legs of which have been previously inserted, in loose manner, flexible strands 2 positioned adjacent the bight 3 of the wire.

Figures 4, 5, 6, 7, 8:
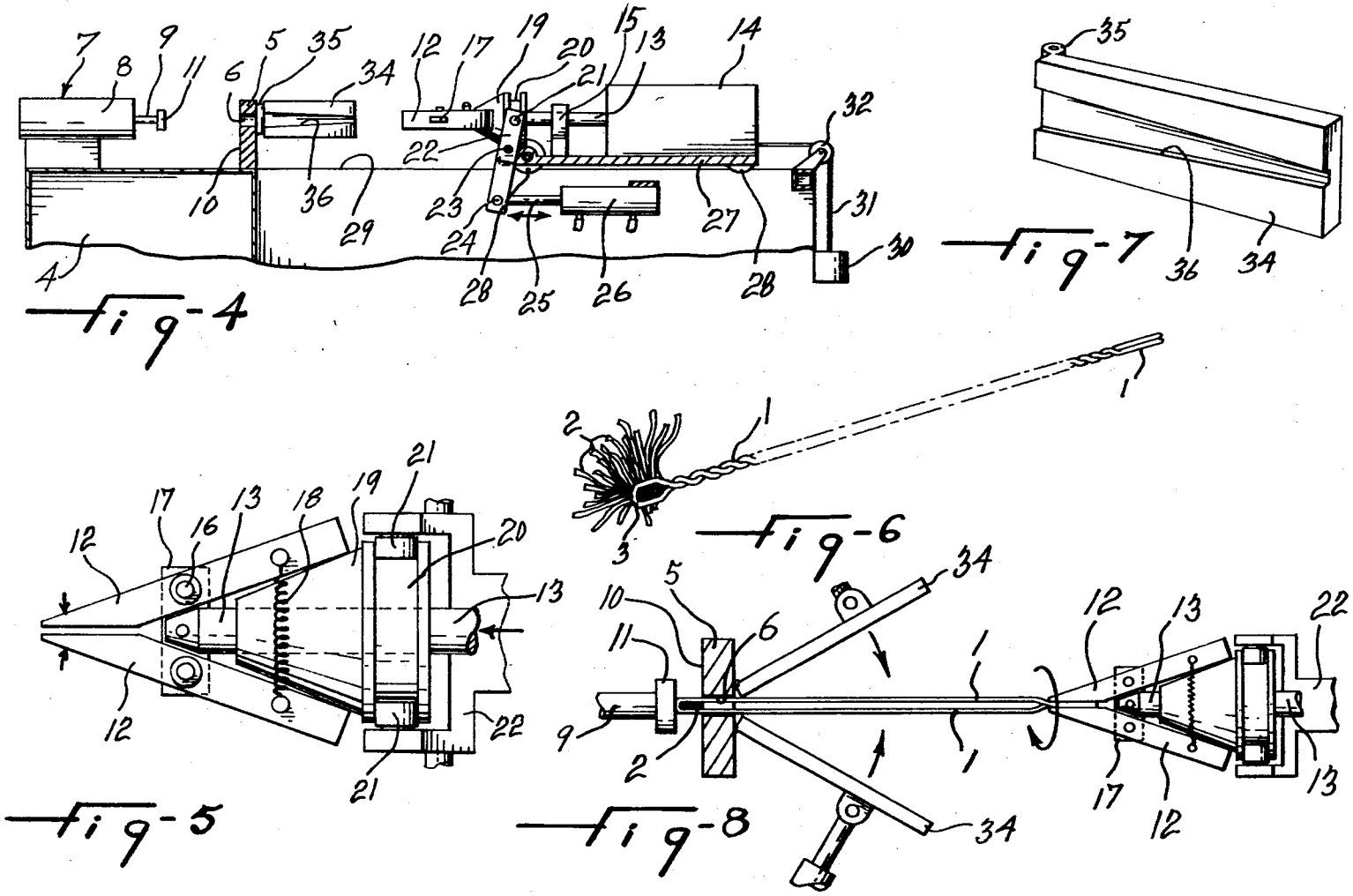
FIG. 4 is a longitudinal section, taken along line 4—4 of FIG. 3.
FIG. 5 is an enlarged top plan view of the pincers and cone assembly.
FIG. 6 is a partial side view of the completed mop as it comes out of the machine.
FIG. 7 is a perspective view of one of the guide plates.
FIG. 8 is a partial view, similar to FIG. 3, but showing the assembly of FIG. 1 in position with the wire ready to be twisted.

After the machine has worked on the assembly of FIG. 1, the legs of the wire have been twisted, as shown in FIG. 6, to thereby firmly lock the strands 2 against the bight 3.

The machine of the invention comprises a frame, or table 4, to which is secured an upstanding holding plate 5 having a through hole 6. Table 4 carries a pusher means, for instance double-acting cylinder and piston unit 7 with the cylinder 8 and piston rod 9 in alignment with the hole 6 of the holding plate 5 and spaced from the forward face 10 of plate 5 a sufficient distance that, when the piston rod 9 is retracted with its pusher pad 11 close to the end of the cylinder 8, sufficient space is provided between the pusher pad 11 and the plate 5 to permit easy positioning of the wire 1 between the same and the insertion of the free ends of the legs of the wire through hole 6 of plate 5.

The unit 7 has a sufficient stroke so that, upon its extension, the pusher pad 11 will press the strands 2 firmly against the front face 10 of holding plate 5 and with sufficient force to prevent rotation of the strands 2 and of the bight 3 during twisting of the wire.

Wire twisting is accomplished by a pair of pincers 12 mounted on the free end of a shaft 13 driven in rotation by a motor 14. The shaft 13 is journalled in a bracket 15 and is in axial alignment with hole 6 of plate 5. Pincers 12 are spaced rearwardly from holding plate 5 a distance sufficient that, when the wire is in position through the hole 6 of plate 5, the free ends of the wire legs will be inserted between the jaws of the open pincers 12.

Power means are preferably provided to open and close the pincers 12. Each pincer jaw is pivoted, intermediate its ends, at 16 on a support 17 carried by the end of shaft 13. A tension spring 18 is attached to the rear end portions of the two pincer jaws and tend to maintain the same in open position.

A cone 19 is mounted on the shaft 13 for rotation therewith, but is free to move longitudinally of the shaft. The conical portion of the cone 19 engages between the rear end portions of the pincer jaws 12, so that forward movement of the cone will forcibly close the pincers.

The cone is moved forwardly or rearwardly along the shaft 13 by the following means. The rear end portion of the cone 19 defines a circumferential groove 20 for receiving a pair of rollers 21 mounted at the ends of a forked lever 22 pivoted intermediate its ends about a transverse pivot 23. The lower end of the forked lever 22 is pivotally connected at 24 to the piston rod 25 of a double-acting cylinder and piston unit 26, which extends longitudinally of shaft 13.

It will be understood that in the extended position of cylinder unit 26, as shown in FIG. 4, the cone 19 is retracted to its rearmost position disengaging the pincers 12, which open under the action of spring 18. Forward movement of the cone 19 by contraction of the cylinder unit 26 causes the rotating cone to engage the rotating pincers and forcibly close the same, thereby to clamp the ends of the legs of the wire 1 inserted between the pincer jaws.

To allow for contraction and shortening of the legs of the wire during twisting, motor 14, shaft 13, pincers 12, bracket 15, together with the forked lever 22 and cylinder unit 26, are mounted on a carriage 27 provided with wheels 28 running on rails 29 which are part of, and form an extension, of table 4.

A counterweight 30 is attached by a string 31 to the carriage 27. Cable 31 is trained on a pulley 32 carried by the rear end of the table 4. Thus, when wire 1 is being twisted by the rotating pincers 12, the latter are allowed to move forwardly against the biasing action of the counterweight 30. Upon release of the wire by the pincers, the carriage 27 automatically returns to its rearward limit position against a stop 33 carried by the rear end of table 4. In this rearward limit position, the open pincers are ready to receive the ends of a new wire 1 inserted through hole 6 of plate 5.

During insertion of the U-shaped wire 1 through the hole 6 of plate 5, it is desirable to positively guide the wire legs for insertion between the open pincers 12. To that effect, a pair of guide plates 34 are pivoted at the back of holding plate 5 for pivotal movement about vertical hinges 35 on each side of the hole 6. The inner face of each guide plate has a groove 36 which, as shown in FIG. 7, tapers longitudinally of the plate outwardly from the hinge connection 35. When the two guide plates 34 are closed one against the other by the respective power-operated double-acting cylinder and piston units 37, the two grooves 36 are in register and longitudinally aligned with the hole 6, whereby the wire legs are maintained together during their insertion between the pincers 12.

The device operates as follows.

With the pincers 12 in open position, the carriage 27 in rearwardly retracted position, the pusher pad 11 forwardly retracted and the guide plates 34 in closed position, the wire 1, with its strands 2, as shown in FIG. 1, is inserted through hole 6 of plate 5 until the strands 2 abut against the front face 10 of plate 5. In this position, the free ends of the wire extend between the open pincers 12. Cylinder and piston unit 7 is operated to move the pusher pad 11 rearwardly to firmly engage the bight 3 and press the strands 2 against the forward face of plate 5, to thereby positively lock the bight 3 against rotation. Then cylinder and piston units 37 are operated to open the guide plates 34, while the cylinder and piston unit 26 is operated to move the cone 19 forwardly and cause closing of the pincers 12 and grasping of the wire 1.

Then motor 14 is actuated to twist the wire legs. During twisting, the carriage 27 is allowed to move forwardly to compensate for contraction of the wire legs during twisting. At the end of the operation, the pusher pad 11 is retracted and the pincers are open, whereby the carriage 27 moves rearwardly to its limit position against stop 33 automatically under action of counterweight 30. The twisted wire and locked strands 2 assembly is then removed from the plate 5 and a fresh untwisted wire and strands assembly are re-inserted through the plate hole 6 after prior closing of the guide plates 34. The cycle is then repeated.

It should be noted that relative longitudinal movement between the pincers and the holding plate 5 could be achieved by mounting the plate 5 together with its guide plates 34 and cylinder and piston unit 7 with pusher pad 11 on a carriage provided with a counterweight, or a tension spring, and mounting the motor 14 and pincers 12 on the table itself in a stationary manner to allow for the contraction of the wire during twisting, instead of the arrangement described in the drawings.

It will be noted that the strands 2 are positively locked in the loop formed by the twisted wire and the bight 3, because no foreign object is inserted into this loop during twisting to prevent rotation of the bight.

The cylinder and piston units of the machine are preferably air operated for fast movement. These units are preferably remote controlled from a single foot or hand actuated operator lever or pedal.

In the claims, the term mop-making machine includes a machine for making puff dusters and other mop-like articles.

What I claim is:

1. A mop-making machine comprising a holding plate having first and second main faces and having a hole extending therethrough and opening at said main faces for receiving the legs of a U-shape wire having flexible mop strands extending transversely between said legs and placed against the bight of the U-shape wire and with said bight protruding from said first main face and with said legs protruding from said second main face, pusher means mounted opposite said first main face of said holding plate and operable to engage said bight and push the same towards said holding plate to cause said bight to press said transversely-extending strands against said first main face of said holding plate with sufficient pressure to prevent rotation of said bight and strands relative to said holding plate during twisting of the wire legs, rotatable pincer means disposed opposite the second main face of said holding plate and rotatable about an axis in alignment with said hole and removably clamping the free ends of the legs of said U-shape wire to cause twisting of said wire legs during rotation of said pincer means, and means to rotate said pincer means about said axis.

2. A machine as claimed in claim 1, further including means allowing relative longitudinal movement between said holding plate and said pincer means to permit longitudinal contraction of the wire legs during their twisting.

3. A machine as claimed in claim 2, wherein said means to rotate said pincer means include a motor, a shaft for said motor, rotatable about an axis passing through said hole, and said pincer means include a pair of pincer jaws pivotally mounted at the free end of said shaft.

4. A machine as claimed in claim 3, further including means to open and close said pincers, said last-named means including a cone member rotatable with said shaft but longitudinally displaceable along the same between a position engaging between the ends of the pincer jaws and causing closing of the same, and a retracted position releasing said pincer jaws, a spring means for biasing said pincer jaws to open position and a power means to move said cone member between said two positions.

5. A machine as claimed in claim 2, wherein said pusher means consist of a double-acting cylinder and piston unit having a piston provided with a pusher pad at its free end with the piston of said unit longitudinally aligned with said hole and with said pincer means spaced from said holding plate in the retracted position of said pusher pad a sufficient distance to allow insertion of a U-shape wire through said hole of said holding plate.

6. A machine as claimed in claim 5, further including two guide plates pivotally mounted on said second main face of said holding plate about parallel axes on each side of the hole of said holding plate, each guide plate having a rearwardly tapering groove which registers with the groove of the other guide plate to form a rearwardly tapering passage when said guide plates are closed one against the other for guiding of the free ends of the legs of said U-shape wire towards said pincer means.

7. A machine as claimed in claim 6, further including means to open and close the guide plates.

8. A machine as claimed in claim 1, 6 or 4, wherein said holding plate and pusher means are mounted on a stationary frame and said pincer means, together with said means to rotate said pincer means, are mounted on a carriage movable on said frame towards and away from said holding plate, and further including means to move said carriage to a retracted limit position in which said pincers are in a position for receiving the free ends of the legs of the U-shape wire therebetween.

* * * * *